US005584714A

United States Patent [19]

Karst et al.

[11] Patent Number: 5,584,714

[45] Date of Patent: Dec. 17, 1996

[54] MODULAR ELECTRICAL RECEPTACLE

[75] Inventors: Ronald E. Karst; Shawn J. Kondas, both of Kendallville, Ind.

[73] Assignee: Pent Assemblies, Inc., Kendallville, Ind.

[21] Appl. No.: 476,359

[22] Filed: Jun. 7, 1995

[51] Int. Cl.[6] ..... H01R 4/60

[52] U.S. Cl. ..... 439/215; 439/107

[58] Field of Search ..... 439/210, 211, 439/212, 214, 215, 650, 653, 107

[56] References Cited

U.S. PATENT DOCUMENTS

| | | | |
|---|---|---|---|
| 4,952,164 | 8/1990 | French et al. | 439/215 |
| 5,013,252 | 5/1991 | Nienhuis et al. | 439/211 |
| 5,131,860 | 7/1992 | Bogiel | 439/211 |

*Primary Examiner*—Neil Abrams
*Assistant Examiner*—Barry Matthew L. Standig
*Attorney, Agent, or Firm*—Taylor & Associates, P.C.

[57] ABSTRACT

The invention is directed to a modular electrical receptacle including a housing and a faceplate. The faceplate is integral with or attached to the housing, and has at least two parallel blade openings and at least two T-slot blade openings. The parallel blade openings are disposed along a common longitudinal axis, and each T-slot blade opening is associated with a respective parallel blade opening. At least one plug-in electrical connector is attached to the housing and/or the faceplate. A conductor member defines at least two T-slot blade sockets, with each T-slot blade socket associated with a respective one of the T-slot blade openings. The conductor member interconnects at least one connector with each T-slot blade socket. The conductor member can be of monolithic or two-piece construction.

4 Claims, 2 Drawing Sheets

MODULAR ELECTRICAL RECEPTACLE

BACKGROUND OF THE INVENTION

1. Field of the invention

The present invention relates to electrical outlet receptacles, and, more particularly, relates to modular electrical outlet receptacles.

2. Description of the related art.

Modular electrical outlet receptacles may be included in a modular office partition, and provide flexibility in terms of system layout, interconnectability with other components of the system, etc. Typically, such a modular electrical receptacle includes at least one connector which is adapted to interfit with a corresponding connector on a wiring harness. The wiring harness typically includes a further connector at an opposing end thereof which extends to another component of the system, such as another electrical receptacle. The connector also includes contacts which are electrically connected to each of the line, neutral and ground conductors disposed within the modular electrical receptacle. The modular electrical receptacle is typically configured as a 15-Amp receptacle, meaning that the blade openings in the faceplate are disposed parallel to each other to accept a common male plug-cap. Accordingly, both the line and neutral conductors extending through the electrical modular receptacle have a portion thereof which is configured as a parallel blade socket.

A problem with known modular electrical receptacles is that they have not heretofore been able to accommodate a 20-Amp male plug-cap, such as by having a transverse blade socket for the neutral conductor which is disposed transverse to a parallel blade socket for the line conductor. In the United States, non-modular electrical receptacles may include a transverse blade socket which is combined with a parallel blade socket to define a T-slot blade socket so that either a 15-Amp or 20-Amp plug-cap may be used. However, such non-modular electrical receptacles do not include a plug-in connector providing fast and easy connection to other components of a system. On the other hand, conventional modular electrical receptacles do not include a T-slot blade socket, likely because of a perceived inability to form the conductor to properly define all of the necessary T-slot blade sockets while at the same time extending to and forming a part of the plug-in connector.

What is needed in the art is a modular electrical receptacle which includes a T-slot blade opening and corresponding T-slot blade socket, and thereby accommodates a 20-Amp male plug-cap.

SUMMARY OF THE INVENTION

The present invention provides a modular electrical receptacle including a housing, at least one plug-in connector, and a faceplate having a parallel blade opening and an associated T-slot blade opening disposed transverse to the parallel blade opening.

The invention comprises, in one form thereof, a modular electrical receptacle including a housing and a faceplate. The faceplate is integral with or attached to the housing, and has at least two parallel blade openings and at least two T-slot blade openings. The parallel blade openings are disposed along a common longitudinal axis, and each T-slot blade opening is associated with a respective parallel blade opening. At least one plug-in electrical connector is attached to the housing and/or the faceplate. A conductor member defines at least two T-slot blade sockets, with each T-slot blade socket associated with a respective one of the T-slot blade openings. The conductor member interconnects at least one connector with each T-slot blade socket.

An advantage of the present invention is that a modular electrical receptacle is provided which allows the use of either a 15-Amp or 20-Amp male plug-cap.

Another advantage is that the neutral conductor providing either the parallel blade socket or T-slot blade socket can be constructed as a monolithic or two-piece design.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
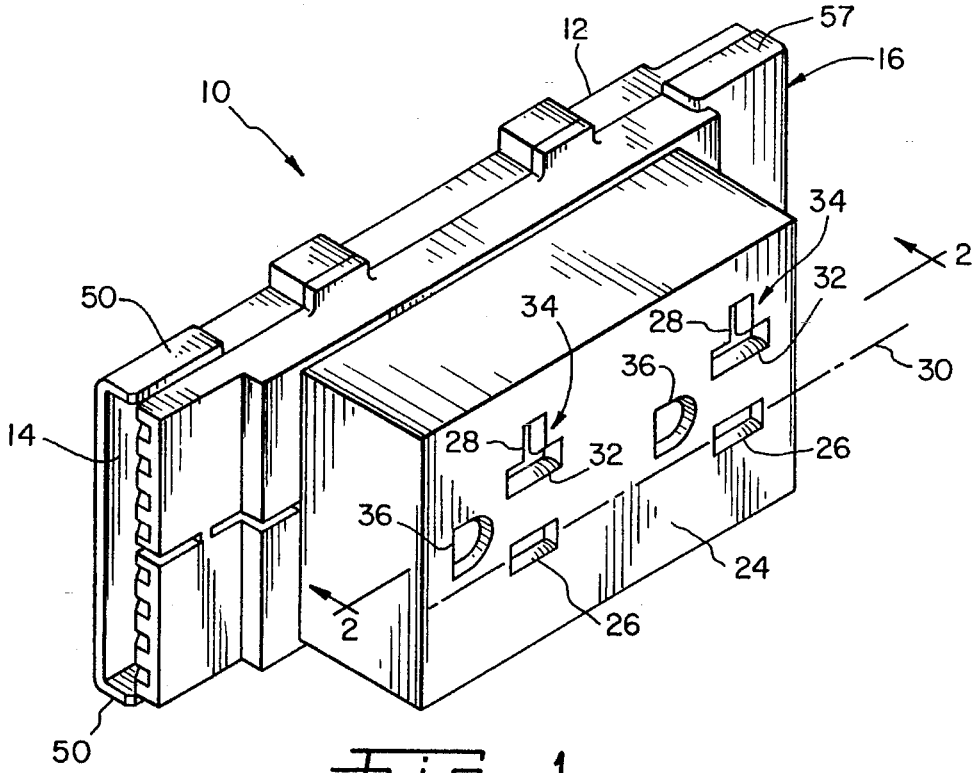
FIG. 1 is a perspective view of an embodiment of a modular electrical receptacle of the present invention.
Figure 2:
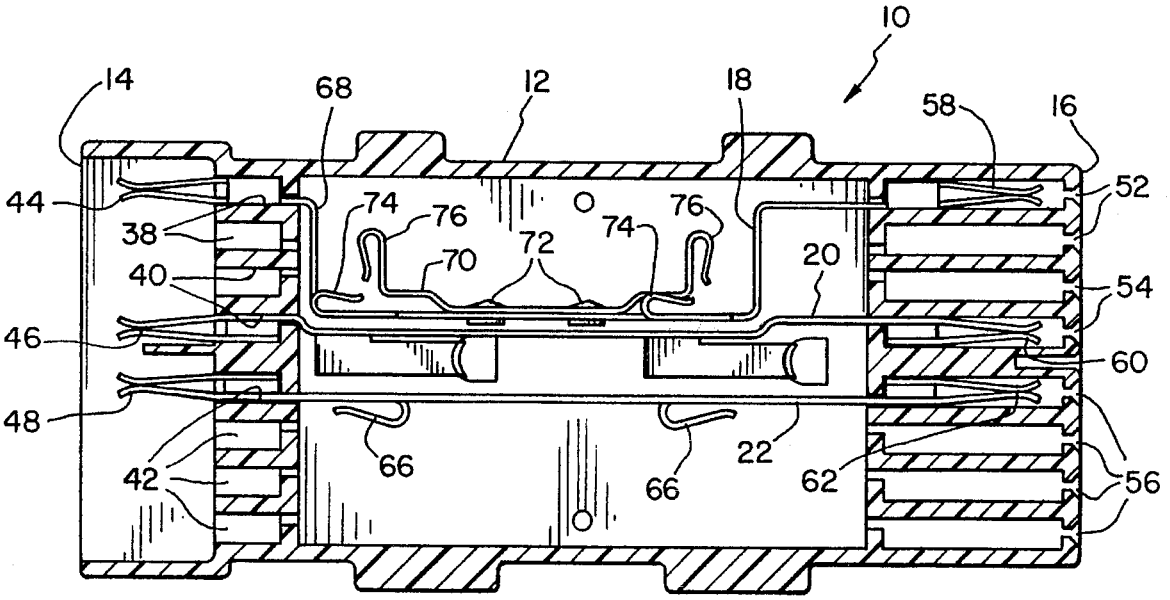
FIG. 2 is a sectional view taken along line 2—2 in FIG. 1 and viewed in the direction of the arrows.

Referring now to the drawings and particularly to FIGS. 1 and 2, an embodiment of a modular electrical receptacle 10 of the present invention is shown. Modular electrical receptacle 10 includes a housing 12, plug-in electrical connectors 14, 16, and conductor members 18, 20 and 22.

Housing 12 includes a faceplate 24 (FIG. 1) which is integral therewith. Alternatively, faceplate 24 can be attached to housing 12. Faceplate 24 has a pair of first or parallel blade openings 26; and a pair of associated second blade openings 28 disposed in spaced apart relationship thereto. First blade openings 26 are disposed in longitudinal alignment with each other, i.e., along a common longitudinal axis 30. Second blade openings 28 are disposed transverse, e.g., orthogonal, to first blade openings 26. Faceplate 24 also includes third blade openings 32 which are disposed in communication with second blade openings 28, and parallel to first blade openings 26. Second blade openings 28 and third blade openings 32 together define T-slot blade openings 34 which are respectively associated with first blade openings 26. Faceplate 24 also includes ground blade openings 36 corresponding to each associated pair of first blade openings 26 and T-slot blade opening 34.

Plug-in electrical connector 14 is a female connector adapted for connection with a male connector of a wiring harness (not shown). Female connector 14 has a plurality of openings 38, 40 and 42 sized for receiving electrical contacts of conductors disposed within housing 12. In the embodiment shown in FIG. 2, openings 38 are reserved for receiving electrical contacts (one of which is shown and referenced 44) of neutral conductors disposed within housing 12; openings 40 are reserved for receiving electrical contacts (one of which is shown and referenced 46) of ground conductors disposed within housing 12; and openings 42 are reserved for receiving electrical contacts (one of which is shown and referenced 48) of line conductors disposed within housing 12. Female connector 14 also includes a flange 50 formed in housing 12 which provides polarization with a mating male connector of a wiring harness, thereby ensuring proper interconnection between modular electrical receptacle 10 and the wiring harness. Of course, the wiring harness includes appropriate blade electrical contacts which interconnect with electrical contacts 44, 46 and 48 of female connector 14.

Plug-in electrical connector 16 is a female connector adapted for connection with a male connector of a wiring harness (not shown). Female connector 16 has a plurality of openings 52, 54 and 56 sized for receiving electrical contacts of conductors disposed within housing 12. As indicated above with regard to female connector 14, openings 52, 54 and 56 are reserved for receiving electrical contacts of neutral, ground and line conductors disposed within housing 12, as indicated. Female connector 16 also includes a flange 57 formed in housing 12 which provides polarization with a mating male connector of a wiring harness, thereby ensuring proper interconnection between modular electrical receptacle 10 and the wiring harness.

Line conductor member 22 includes two parallel blade sockets 66 which are respectively associated with first blade openings 26. Parallel blade sockets 66 are disposed along a common longitudinal axis (not numbered) which is parallel to longitudinal axis 30 shown in FIG. 1. Line conductor 22 is of monolithic construction and extends from electrical contact 48 within female connector 14 to electrical contact 62 within female connector 16.

Ground conductor member 20 is of generally known construction and extends from electrical contact 46 within female connector 14 to electrical contact 60 within female connector 16.

Figure 3:
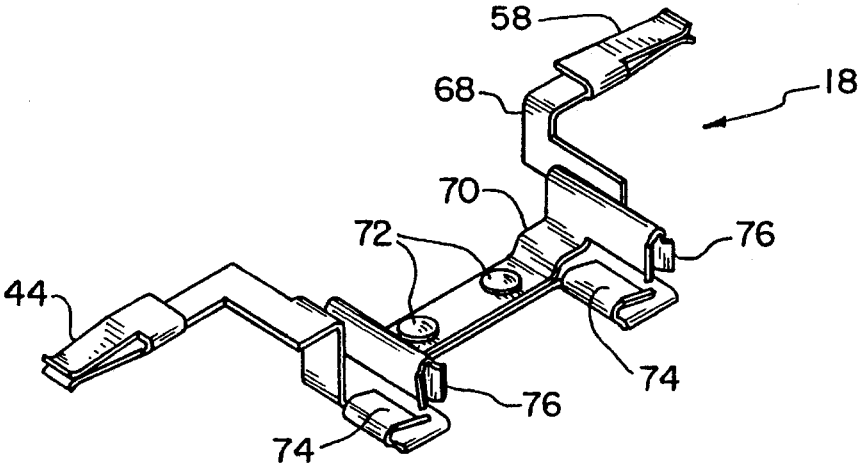
FIG. 3 is a perspective view of the neutral conductor member shown in FIG. 2.

According to one aspect of the invention, neutral conductor member 18 includes a first part 68 and a second part 70 which are attached together, such as by rivets 72. Other methods of attachment between first part 68 and second part 70 are also possible. Thus, it is apparent that neutral conductor member 18 in the embodiment shown in FIGS. 2 and 3 is of two-piece construction. First part 68 includes electrical contact 44 disposed within female connector 14 and extends to and includes electrical contact 58 disposed within female connector 16. First part 68 defines parallel blade sockets 74 which when disposed in housing 12 are located generally parallel to parallel blade sockets 66 of line conductor 22. Second part 70 includes transverse blade sockets 76 which are disposed generally perpendicular to parallel blade socket 74 when disposed in housing 12, and perpendicular to parallel blade socket 66. Parallel blades sockets 74 and transverse blade sockets 76 together define a pair of T-slot blade sockets (not numbered) which are respectively associated with parallel blade sockets 66 (FIG. 2) of line conductor 22, and T-slot blade openings 34 (FIG. 1) of faceplate 24.

Figure 4:
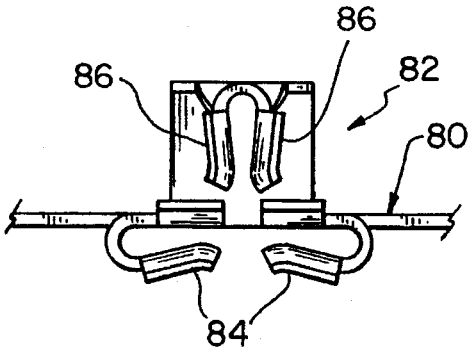
FIG. 4 is a fragmentary, top view of another embodiment of a neutral conductor member for use with the modular electrical receptacle of the present invention.
Figure 5:
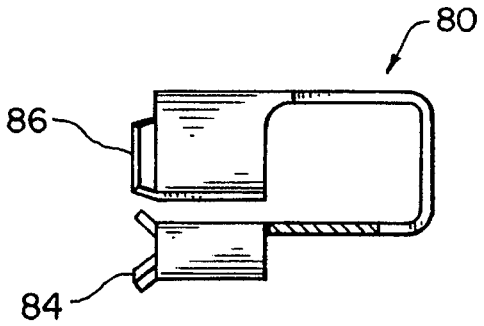
FIG. 5 is a fragmentary, side view of the neutral conductor member shown in FIG. 4.

Referring now to FIGS. 4 and 5, a fragmentary top view of another embodiment of a neutral conductor of the present invention is shown. A neutral conductor 80 includes a T-slot blade socket 82 having a parallel blade socket defined by bent portions 84; and a transverse blade socket defined by bent portions 86. Bent portions 84 are disposed on one side of extending portion 96 which extends to and connects with plug-in electrical connectors 14, 16 at each end of modular electrical receptacle 10. As is apparent, neutral conductor 80 includes a T-slot blade socket 82 which is of monolithic construction.

Figure 6:
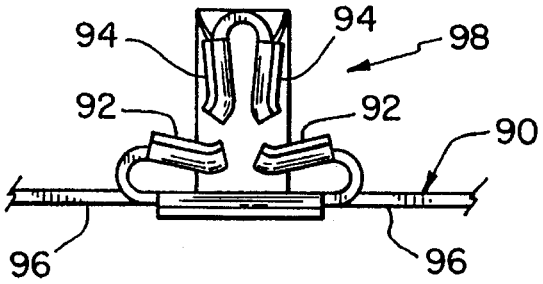
FIG. 6 is a fragmentary, top view of another embodiment of a neutral conductor member for use with the modular electrical receptacle of the present invention.
Figure 7:
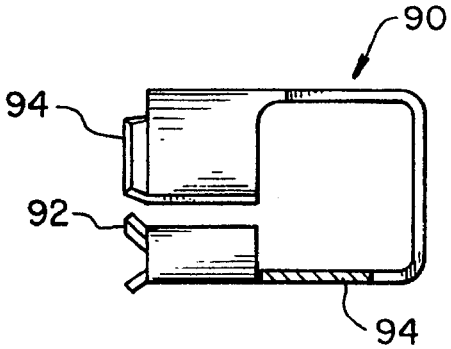
FIG. 7 is a fragmentary, side view of the neutral conductor member shown in FIG. 6.

Referring now to FIGS. 6 and 7, a fragmentary top view of another embodiment of a neutral conductor 90 is shown. Neutral conductor 90 is similar to the embodiment of neutral conductor 80 shown in FIGS. 4 and 5, except that bent portions 92 are disposed on the opposite side of extending portion 96 which extends to and connects with plug-in electrical connectors 14, 16 at each end of modular electrical receptacle 10. Bent portions 92 and bent portions 94 define a T-slot blade socket 98.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular electrical receptacle, comprising:

a housing;

a faceplate being one of integral with and attached to said housing, said faceplate having at least two parallel blade openings and at least two T-slot blade openings, said parallel blade openings disposed along a common longitudinal axis, each said T-slot blade opening associated with a respective said parallel blade opening;

two plug-in electrical connectors, each said connector including a plurality of electrical contact receiving openings, each said connector being directly attached to opposing ends of at least one of said housing and said faceplate; and a rigid conductor member defining at least two T-slot blade sockets, each said T-slot blade socket associated with a respective one of said T-slot blade openings, said conductor member interconnecting each said connector with each said T-slot blade socket.

2. The modular electrical receptacle of claim 1, wherein said conductor member is monolithic.

3. A modular electrical receptacle, comprising:

a housing;

two plug-in electrical connectors, each said connector including a plurality of electrical contact receiving openings, each said connector being directly attached to opposing ends of said housing;

a first conductor member defining at least two parallel blade sockets, said parallel blade sockets disposed along a common longitudinal axis; and a second rig conductor member defining at least two T-slot blade sockets, each said T-slot blade socket disposed in association with a respective said parallel blade socket;

wherein each of said first conductor member and said second conductor member extends to and connects with at least one said connector.

4. A modular electrical receptacle, comprising:

a housing;

two plug-in electrical connectors, each said connector being directly connected to opposing ends of said housing, each said connector including a plurality of electrical contact receiving openings;

a first conductor member disposed within said housing and defining at least one parallel blade socket; and a second rigid conductor member disposed within said housing defining at least one T-slot blade socket associated with said parallel blade socket;

wherein each of said first conductor member and said second conductor member extends to and connects with each of said connectors.

* * * * *

UNITED STATES PATENT AND TRADEMARK OFFICE

CERTIFICATE OF CORRECTION

PATENT NO. : 5,584,714

DATED : December 17, 1996

INVENTOR(S) : Ronald E. Karst, et al.

It is certified that error appears in the above-indentified patent and that said Letters Patent is hereby corrected as shown below:

COLUMN 4

Line 64, delete "rig" and substitute --rigid-- therefor.

COLUMN 6

Line 4, after "housing" insert --and--.

Signed and Sealed this

Eighteenth Day of March, 1997

*Attest:*

Bruce Lehman

BRUCE LEHMAN

*Attesting Officer*

*Commissioner of Patents and Trademarks*